US005744018A

United States Patent [19]

Santoyo et al.

[11] Patent Number: 5,744,018

[45] Date of Patent: Apr. 28, 1998

[54] PREVENTING ESCAPE OF VAPOR OR GAS FROM ELECTROLYTIC SYSTEMS

[76] Inventors: Manuel G. Santoyo, 8051 E. Kenyon Dr., Tucson, Ariz. 85710; James A. Murray, 3535 Cassena Dr., Walnut Creek, Calif. 94598; Graeme Alexander, 4371 N. Camino Ferreo, Tucson, Ariz. 85715; Ron Tix, 1178 W. Fourteen St., Hastings, Minn. 55033; Dale F. Halter, 2353 Country Dr., Fremont, Calif. 94536

[21] Appl. No.: 711,561

[22] Filed: Sep. 10, 1996

[51] Int. Cl.[6] ..... C25B 9/00; C25B 15/00; C25D 21/04

[52] U.S. Cl. ..... 205/94; 204/278; 204/279; 204/270

[58] Field of Search ..... 204/270, 278, 204/279; 205/560, 94

[56] References Cited

U.S. PATENT DOCUMENTS 4,411,760 10/1983 Guerriero et al. ..... 204/278 X
4,668,353 5/1987 Smith et al. ..... 204/278 X
5,470,445 11/1995 Murray et al. ..... 204/105 R
5,609,738 3/1997 Murray et al. ..... 204/279 X

*Primary Examiner*—Donald R. Valentine
*Attorney, Agent, or Firm*—Antonio R. Durando

[57] ABSTRACT

An electrolytic processing tank contains alternating cathodes and anodes. Each anode carries a sealing unit on either side thereof. The sealing units include flexible U-shaped sealing members which are in surface contact with neighboring cathodes. A sealing member which is T-shaped as seen in an end view is positioned adjacent the end of each anode. Each T-shaped member has a leg whose thickness is the same as that of the anodes, and a crosspiece which extends partway along the leg. The leg is aligned with a neighboring anode, and the end of the leg remote from the crosspiece abuts the anode. The crosspiece projects beyond the opposite end of the leg to form a flexible flap which establishes a seal with a wall of the processing tank. The crosspieces of neighboring T-shaped members overlap one another.

22 Claims, 3 Drawing Sheets

PREVENTING ESCAPE OF VAPOR OR GAS FROM ELECTROLYTIC SYSTEMS

BACKGROUND OF THE INVENTION

1. Field of the Invention

The invention relates to an arrangement for and a method of inhibiting the escape of vapor or gas from an electrolytic system.

2. Description of the Prior Art

Electrolytic processes such as electrowinning and electrorefining are carried out in tanks containing an array of alternating anodes and cathodes which are positioned side-by-side. These processes typically generate fumes which are harmful to personnel as well as equipment. For instance, a corrosive acid mist is produced during the electrowinning of copper.

Evacuating systems have been devised in order to reduce the escape of fumes into the surroundings. However, when used by themselves, such evacuating systems are unable to effectively prevent fumes from escaping.

U.S. Pat. No. 5,470,445 discloses a fume containment system for enhancing the operation of an evacuating system. In this containment system, a flexible sealing member is mounted on either side of an anode above the level of the electrolytic bath. Each sealing member is in the form of a flap which is rigidly attached to a support and tapers to a narrow edge in a direction away from the support. The support is fastened to one side of an anode and, depending upon the location of the anode, the narrow edge of the flap abuts either the opposing side of a neighboring cathode or an end wall of the electrolytic processing tank. The end walls run parallel to the electrodes and the supports. The flaps constitute part of a roof which prevents fumes from rising and allows the fumes to be drawn out by an evacuating system.

Another part of the roof consists of flexible pads attached to the ends of at least some of the supports. The ends of the supports face the side walls of the electrolytic processing tank, that is, the walls which are normal to the electrodes and the supports, and the pads are arranged to bear against the side walls. The dimensions of the pads are such that neighboring pads overlap one another.

The flaps make line contact with the cathodes and the end walls of the electrolytic processing tank. Consequently, the seals formed by the flaps are very sensitive to misalignments as well as to irregularities in the cathodes and the end walls. Small misalignments, or small irregularities in the cathodes and the end walls, result in gaps and accompanying leaks.

The pads are asymmetrically mounted on the supports. This causes a twisting action which can again lead to gaps.

SUMMARY OF THE INVENTION

It is an object of the invention to provide an arrangement which enables improved seals to be obtained.

Another object of the invention is to provide a method which makes it possible to form better seals.

The preceding objects, as well as others which will become apparent as the description proceeds, are achieved by the invention.

One aspect of the invention resides in an arrangement for inhibiting the escape of vapor or gas from an electrolytic system which includes an electrolytic bath and a plurality of electrodes extending into the bath. The arrangement comprises a flexible sealing member for making surface contact with an electrode.

The surface contact which can be established by the sealing member allows a relatively high degree of forgiveness to be obtained. This forgiveness enables the sealing member to compensate for misalignments and to conform to irregularities.

Another aspect of the invention resides in an arrangement for inhibiting the escape of vapor or gas from an electrolytic system which includes a vessel having a wall and an electrolytic bath in the vessel. This arrangement comprises a sealing member for establishing contact with the vessel wall, and such sealing member is at least approximately T-shaped in an end view of the sealing member.

The crosspiece of a T is symmetrical about the leg of the T. Thus, if contact with the vessel wall is established using the crosspiece of the T-shaped sealing member, twisting can be largely avoided. This makes it possible to reduce gap formation and the accompanying leakage.

An additional aspect of the invention resides in a method of inhibiting the escape of vapor or gas from an electrolytic system which includes an electrolytic processing vessel, an electrolytic bath in the vessel, and at least one electrode extending into the bath. The method comprises the step of establishing surface contact between the electrode and a sealing member.

The method may also comprise the steps of establishing surface contact between a second electrode and a second sealing member, establishing contact between a wall of the processing vessel and a third sealing member, and confining at least a portion of the third sealing member between the other two sealing members.

A further aspect of the invention again resides in a method of inhibiting the escape of vapor or gas from an electrolytic system which includes an electrolytic processing vessel, an electrolytic bath in the vessel, and an electrode extending into the bath. Such method comprises the steps of establishing contact between a wall of the processing vessel and a sealing member, and substantially aligning a selected portion of the sealing member with the electrode.

The method can here additionally comprise the step of abutting the selected portion of the sealing member against a substantially complementary part of the electrode which is in alignment with the selected portion.

Additional features and advantages of the invention will be forthcoming from the following detailed description of preferred embodiments when read in conjunction with the accompanying drawings.

DESCRIPTION OF THE PREFERRED EMBODIMENTS

Figure 1:
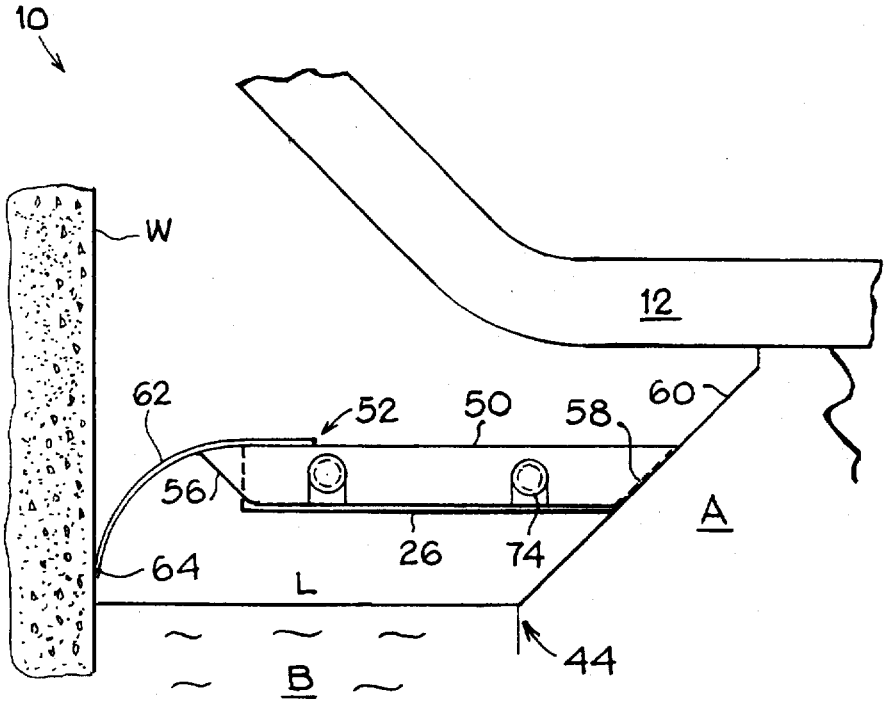
FIG. 1 is a fragmentary transverse sectional view of an electrolytic system in accordance with the invention.
Figure 2:
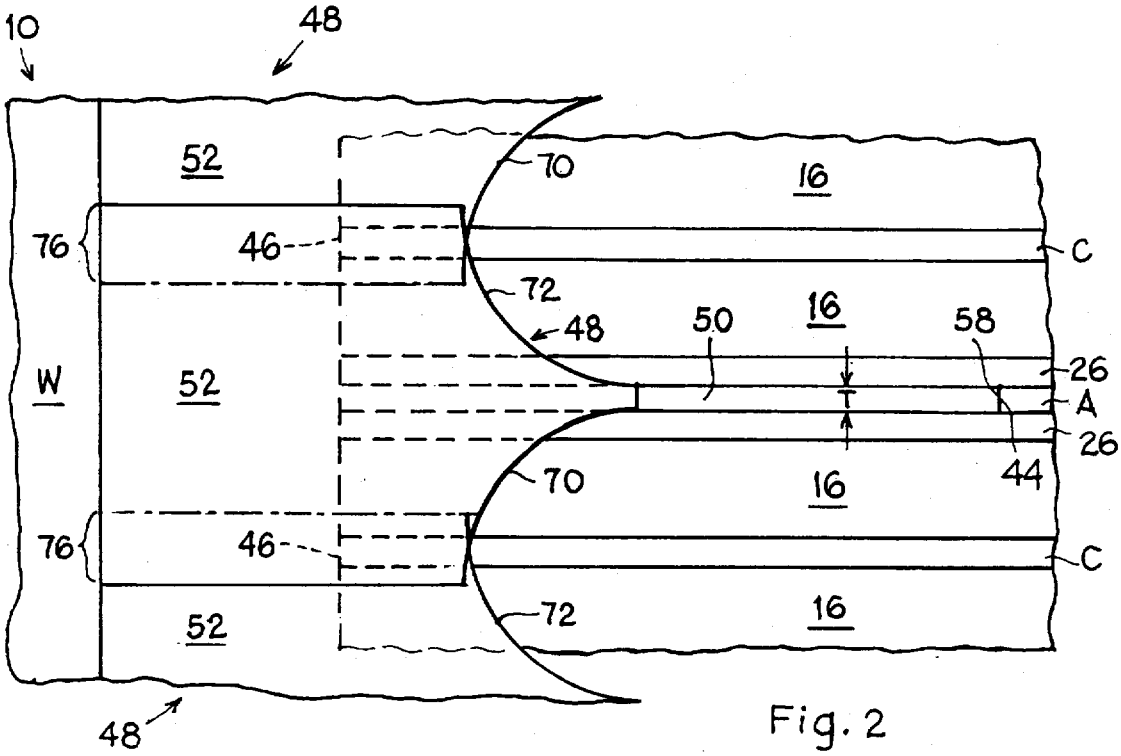
FIG. 2 is a fragmentary plan view of the system of FIG. 1.
Figure 3:
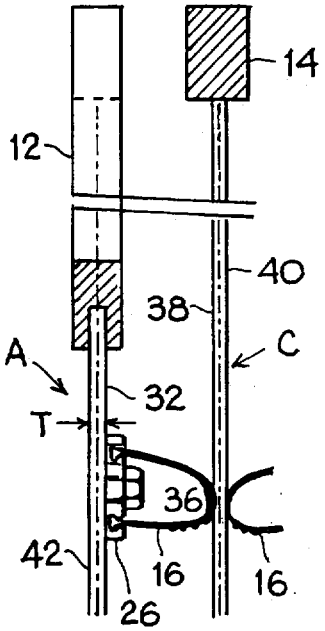
FIG. 3 is a fragmentary elevational end view of two electrodes constituting part of the system of FIG. 1.

Referring to FIGS. 1–3, an electrolytic system is denoted generally by 10. The electrolytic system 10 is assumed to be an electrowinning system for copper but could just as well be an electrorefining system for copper, or some other type of electrolytic system. The electrolytic system 10 includes an electrolytic processing tank or vessel of which a wall W can be seen. The tank wall W is a side wall which extends lengthwise of the processing tank. The processing tank accommodates an electrolytic bath B which has a level L and is here a solution of copper sulfate in sulfuric acid.

Anodes A and cathodes C in the form of flat plates extend into the electrolytic bath B. The anodes A and cathodes C run widthwise of the processing tank in a direction from one tank side wall to the other but terminate somewhat short of the side walls. Lengthwise of the processing tank, anodes A alternate with cathodes C. The anodes A are connected to a source of electricity through electrical connectors 12 while the cathodes C are connected to a source of electricity by way of connectors 14.

The electrolytic bath B releases noxious vapors and gases including an acid mist. The electrolytic system 10 is typically located in a tank house and, if these vapors and gases are allowed to rise into the atmosphere of the tank house, it becomes difficult to evacuate them from the tank house. To prevent the escape of vapors and gases from the electrolytic system 10, the invention provides a containment system within the processing tank above the level L of the electrolytic bath B.

Figure 4:
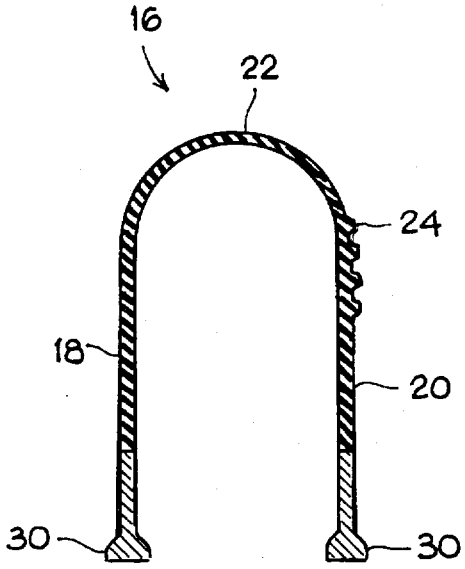
FIG. 4 is an end view of a sealing member constituting part of the system of FIG. 1.

The containment system includes a plurality of flexible sealing members of which one is shown at 16 in FIG. 4. The sealing member 16, which is U-shaped as seen in the end view of FIG. 4 and has a length equal to that of the cathodes C, includes a pair of legs 18 and 20 which are connected to each other by a curved web 22. A series of ridges 24 is formed on an outer surface portion of the sealing member 16 in the region of the juncture between the web 22 and the leg 20. The ridges 24 extend over the length of the sealing member 16.

The sealing member 16 can, for instance, be made of rubber.

Figure 5:
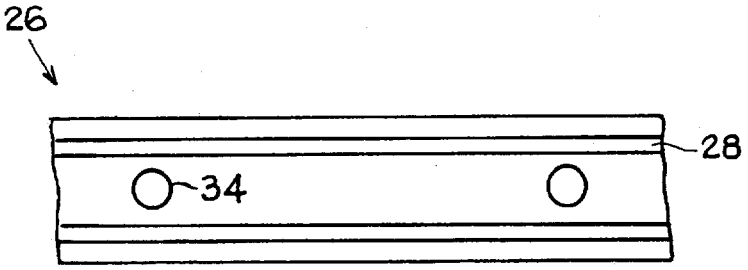
FIG. 5 is a fragmentary plan view of a carrier for the sealing member of FIG. 4.
Figure 6:
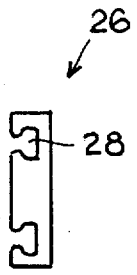
FIG. 6 is an end view of the carrier of FIG. 5.

FIGS. 5 and 6 illustrate a carrier or support 26 for the sealing member 16. The carrier 26, which is generally rectangular as seen in the end view of FIG. 6, has the same length as the cathodes C. The carrier 26 is provided with a pair of transversely spaced grooves or channels 28 which run the length, and are open at either end, of the carrier 26. The grooves 28 are undercut.

The carrier 26 is preferably made of polyethylene and may, for example, be produced by extrusion.

Considering again FIG. 4, the free ends of the legs 18, 20 of the sealing member 16 have ribs or enlargements 30 which extend over the length of the sealing member 16. The ribs 30 are designed to be slidably received in the grooves 28 of the carrier 26 so that the sealing member 16 can be removably mounted on, or releasably connected with, the carrier 26. The carrier 26 and the sealing member 16 can be considered to constitute a sealing unit.

With reference to FIGS. 3 and 5, the sealing unit 16, 26 is mounted on a major surface 32 of an anode A. To this end, the carrier 26 is formed with openings 34 which register with respective openings in the anode A. Fasteners 36, e.g., bolts, pass through the registering openings to connect the carrier 26 to the anode A. The carrier 26 and sealing member 16 extend lengthwise of the anode A which, in turn, extends widthwise of the processing tank.

As shown in FIG. 3, the sealing unit 16,26 bridges the gap between the anode A and a neighboring cathode C which faces the major surface 32 of the anode A. The cathode C has a major surface 38 which faces the anode A, and the web 22 of the sealing member 16 is in surface contact with the major surface 38 of the cathode C and forms a seal therewith. The sealing member 16 is positioned with the ridges 24 facing downward toward the electrolytic bath B.

During electrowinning, copper deposits on the cathode C. The cathode C is periodically removed from the electrolytic bath B to harvest the deposited copper. Removal of the cathode C from the electrolytic bath B is accomplished by drawing the cathode C upward. Since the copper deposits on the cathode C non-uniformly so that the deposited copper has irregular edges, the sealing member 16 is subjected to a great deal of abrasion when the cathode C is withdrawn from the electrolytic bath B. The ridges 24 function to protect the sealing member 16 against such abrasion.

Evaporation from the electrolytic bath B leads to condensation on the downward facing surface portion of the sealing member 16. Inasmuch as the condensate is acidic and can harm the cathode C, it is desirable to prevent flow of the condensate along the sealing member 16 to the cathode C. The ridges 24, in addition to offering abrasion resistance, serve as barriers to such condensate flow.

FIG. 3 shows that the second major surface 40 of the cathode C, which faces away from the anode A, is also in surface contact with a sealing member 16. The two sealing members 16 which abut the cathode C are located directly opposite one another. A second sealing unit 16,26, which has not been illustrated in FIG. 3, is mounted on the second major surface 42 of the anode A directly opposite the illustrated sealing unit 16, 26.

Figure 8:
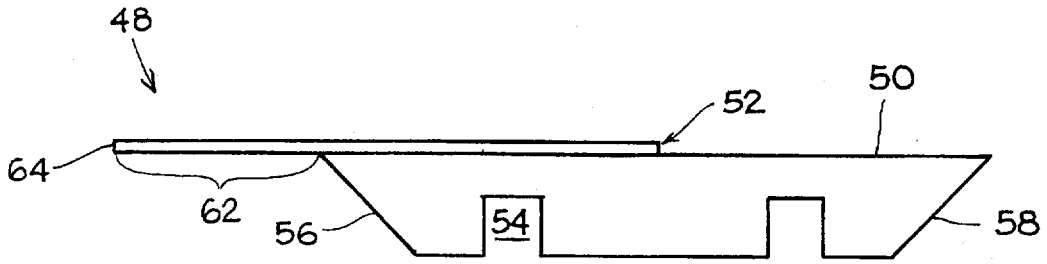
FIG. 8 is a side view of the sealing member of FIG. 7.
Figure 9:
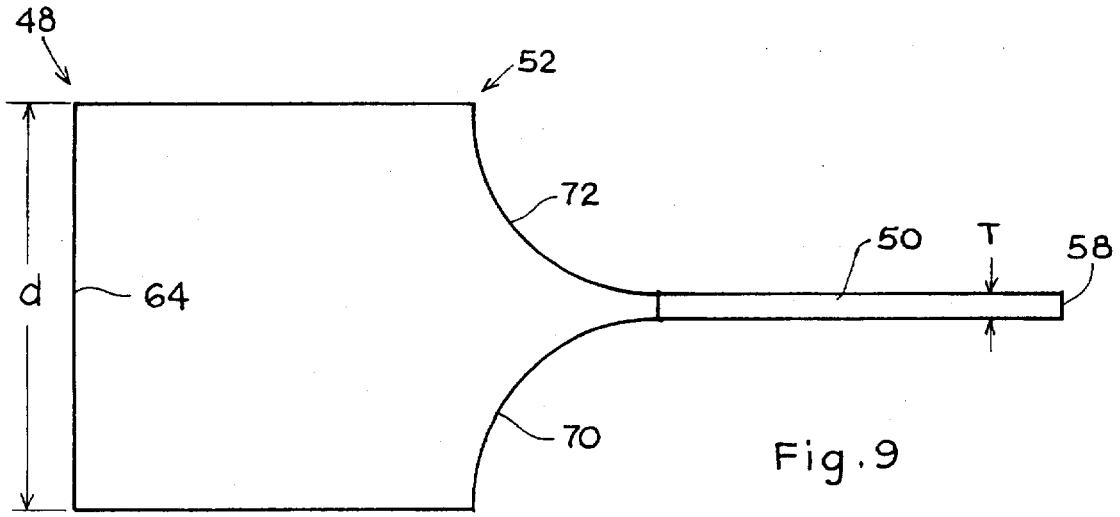
FIG. 9 is a plan view of the sealing member of FIG. 7.

As seen in FIGS. 1 and 2, the anodes A have longitudinal ends 44 which face and are spaced from the tank side wall W while the cathodes C have longitudinal ends 46 which face and are spaced from the tank side wall W. In order to seal the gaps between the ends 44, 46 and the wall W, a sealing member 48 illustrated in FIGS. 7–9 is employed.

Figure 7:
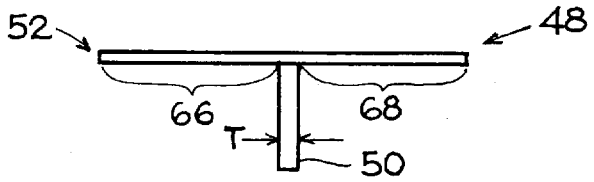
FIG. 7 is an end view of another sealing member constituting part of the system of FIG. 1.

The sealing member 48 is T-shaped as seen in the end view of FIG. 7 and includes a web or carrier portion 50 and a crosspiece or sealing portion 52. The crosspiece 52, which is fast with the web 50, extends partway along the latter.

The web 50 has a thickness T which equals the thickness T of the anodes A, and the web 50 is provided with cutouts 54 which can be aligned with respective openings 34 of a sealing unit 16, 26. The cutouts 54 permit the carrier 26 of a sealing unit 16, 26 to be connected to the web 50.

The web 50 has opposed longitudinal ends 56 and 58. When the sealing member 48 is mounted in the processing tank, the longitudinal end 56 faces the tank side wall W while the longitudinal end 58 faces an anode A.

FIG. 1 shows that the longitudinal end 44 of an anode A includes a sloped or inclined part 60. As illustrated in FIG. 8, the longitudinal end 58 of the sealing member 48 has the same slope or inclination as the inclined part 60 so that the longitudinal end 58 is complementary to the inclined part 60.

The crosspiece 52 of the sealing member 48 comprises a flexible section or portion 62 which projects beyond the longitudinal end 56, and to either side, of the web 50. The projecting section 62 has a straight edge 64 remote from, and extending transverse to, the web 50.

The part of the crosspiece 52 between the longitudinal ends 56, 58 of the sealing member 48 includes a pair of flexible sections or portions 66 and 68 which extend to opposite sides of the web 50. The projecting sections 66, 68 have respective concave edges 70 and 72 which face the longitudinal end 58 of the sealing member 48.

The projecting sections 62, 64, 66 can be referred to as flaps.

The sealing member 48 is preferably made of low-density polyethylene and may, for instance, be produced by injection molding.

Referring to FIGS. 1 and 2, the sealing member 48 is inserted in the processing tank with the web 50 oriented vertically and in line with an anode A. The longitudinal end 58 of the sealing member 48 faces the anode A and is abutted with the inclined part 60 of the longitudinal end 44 of the anode A. On the other hand, the longitudinal end 56 of the sealing member 48 faces the tank side wall W but is spaced therefrom. The gap between the longitudinal end 56 and the wall W is bridged by the projecting section 62 of the crosspiece 52. The projecting section 62 contacts the wall W and is bent downward. Since the projecting section 62 is flexible and attempts to return to a straight position, the projecting section 62 forms a seal with the wall W.

As seen in FIG. 2, the cathodes C are longer than the anodes A and project beyond the ends 44 of the anodes A. Inasmuch as the sealing units 16, 26 have the same length as the cathodes C, the sealing units 16, 26 likewise project beyond the ends 44 of the anodes A. Due to the fact that the web 50 of a sealing member 48 is in alignment with, and effectively constitutes an extension of, an anode A, the web 50 is bounded on either side by the sealing units 16, 26 mounted on the opposed major surfaces 32, 42 of the anode A. The cutouts 54 in the web 50 register with respective openings 34 of the adjoining sealing units 16, 26, and the sealing units 16, 26 are connected to the web 50 by fasteners 74, e.g., bolts, shown in FIG. 1.

In order to establish an essentially uninterrupted seal in the vicinity of the tank side wall W lengthwise of the processing tank, it is preferred for neighboring ones of the crosspieces 52 to overlap one another. To this end, the length "d" of a crosspiece 52 (FIG. 9) as measured transverse to the web 50 is such that the crosspiece 52 overlies an end portion of the cathode C to either side of the web 50. FIG. 2 illustrates three crosspieces 52 of which the middle one overlies the end portions of two neighboring cathodes C. The three crosspieces 52 define an area of overlap 76 to either side of the web 50 of the middle crosspiece 52.

The two end walls of the processing tank are in surface contact with the sealing members 16 of respective sealing units 16, 26. This results in the establishment of seals at the tank end walls.

The sealing units 16, 26 and sealing members 48 form a ceiling or roof above the electrolytic bath B, and the ceiling 16, 26, 48 inhibits the escape of vapor or gas into the environment of the tank house. The vapors and gases liberated by the electrolytic bath B are drawn out from the space beneath the ceiling 16, 26, 48 by an evacuating system. While air may be able to enter the space below the ceiling 16, 26, 48 through the latter, this does not present a problem and may even be desirable.

The "bubble" design of the sealing unit 16, 26 allows the sealing member 16 to establish surface contact with the cathodes C and the end walls of the processing tank. The surface contact, in turn, enables a good sealing action to be obtained and makes it possible for the sealing member 16 to conform to irregularities in the cathodes C and the tank end walls. Furthermore, the relatively slidable coupling elements 28, 30 of the carrier 26 and sealing member 16 permit the sealing member 16 to be replaced without discarding the carrier 26. In addition, the ridges 24 on the sealing member 16 provide resistance to abrasion thereby allowing the life of the sealing member 16 to be prolonged.

Due to the T shape of the sealing member 48, the crosspiece 52 is symmetrical about the web 50. Consequently, when the projecting section 62 of the crosspiece 52 is bent to establish a seal with the tank side wall W, the projecting section 62 is subjected to little or no twisting. This, in turn, enables a good seal to be obtained.

Various modifications are possible within the meaning and range of equivalence of the appended claims.

We claim:

1. An arrangement for inhibiting the escape of vapor or gas from an electrolytic system which includes a plurality of electrodes, said arrangement comprising:

a flexible sealing member for making contact with a selected electrode; and a support for said flexible member, said support and said flexible member being provided with cooperating coupling elements for releasably mounting said flexible member on said support, and said coupling elements including an undercut groove in one of said support and said flexible member and a rib on the other of said support and said flexible member, said rib being slidable in said groove.

2. The arrangement of claim 1, wherein said flexible member is generally U-shaped.

3. The arrangement of claim 1, wherein said flexible member has an exterior surface portion which faces downward when said flexible member is in the electrolytic system, said flexible member being provided with a plurality of ridges which protrude beyond said surface portion to inhibit wear of said surface portion.

4. The arrangement of claim 1 for use when the electrolytic system includes a vessel having a wall, further comprising a second sealing member for establishing contact with the vessel wall, said second sealing member being at least approximately T-shaped in an end view of said second sealing member.

5. The arrangement of claim 4, wherein said second sealing member comprises an elongated web having opposite longitudinal ends, and a flexible crosspiece projecting to either side of said web and beyond one of said longitudinal ends.

6. The arrangement of claim 5 for use when a second electrode having a thickness is located next to the selected electrode and the electrodes extend transverse to the vessel wall, wherein said web has a thickness at least approximately equal to the thickness of the second electrode and is alignable with the second electrode when said one longitudinal end faces, and said crosspiece abuts, the vessel wall.

7. The arrangement of claim 6 for use when the second electrode has an end which faces and is spaced from the vessel wall, wherein the other longitudinal end of said web is substantially complementary to part of the end of the second electrode.

8. An electrolytic system comprising:

a vessel adapted to contain an electrolytic bath;

a first electrode extending into said vessel;

a second electrode extending into said vessel; and at least one flexible sealing member mounted on said second electrode, said one flexible member including a hollow free flexible end in contact with said first electrode.

9. The system of claim 8, wherein said one flexible member is generally U-shaped.

10. The system of claim 8, wherein said one flexible member has an exterior surface portion which faces downward, said one flexible member being provided with a plurality of ridges which protrude beyond said surface portion to inhibit wear of said surface portion.

11. The system of claim 8, further comprising a support for said one flexible member, said support and said one flexible member being provided with cooperating coupling elements for releasably mounting said one flexible member on said support.

12. The system of claim 11, further comprising a fastener connecting said support to said second electrode.

13. An electrolytic system comprising:

a vessel adapted to contain an electrolytic bath;

a first electrode extending into said vessel;

a second electrode extending into said vessel;

a flexible sealing member mounted on said second electrode, said flexible member being in contact with said first electrode; and a support for said flexible member said support and said flexible member being provided with cooperating coupling elements for releasably mounting said flexible member on said support, and said coupling elements including an undercut groove in one of said support and said flexible member and a rib on the other of said support and said flexible member, said rib being slidable in said groove.

14. An electrolytic system comprising:

a vessel having a wall and being adapted to contain an electrolytic bath;

a first electrode extending into said vessel;

a second electrode extending into said vessel;

a third electrode extending into said vessel, said second electrode being located between said first electrode and said third electrode;

a first flexible sealing member;

a first support for said first flexible member mounted on said second electrode, said first support holding said first flexible member in contact with said first electrode;

a second flexible sealing member;

a second support for said second flexible member mounted on said second electrode, said second support holding said second flexible member in contact with said third electrode; and a third sealing member for establishing contact with said wall, said third sealing member being at least approximately T-shaped in an end view of said third sealing member, and said third sealing member including a web, and a flexible crosspiece fast with said web and projecting to opposite sides thereof, said web being sandwiched between said first support and said second support, and said flexible crosspiece bearing against said wall.

15. The system of claim 14, wherein said second electrode has a thickness, said web having a thickness at least approximately equal to said thickness of said second electrode, and said web being in substantial alignment with said second electrode.

16. The system of claim 14, wherein said second electrode has an electrode end and said web has a longitudinal end which abuts said electrode end, said longitudinal end being substantially complementary to part of said electrode end.

17. The system of claim 14, wherein said second electrode has a first electrode surface and an opposed second electrode surface, said web having a first web surface which is substantially flush with said first electrode surface, and said web also having a second web surface which is substantially flush with said second electrode surface, said first surfaces facing said first electrode and said second surfaces facing said third electrode, and said first flexible member extending along at least a portion of said first electrode surface and at least a portion of said first web surface, said second flexible member extending along at least a portion of said second electrode surface and at least a portion of said second web surface.

18. The system of claim 14, wherein said first flexible member and said first electrode have a first contact area, said second flexible member and said third electrode having a second contact area, and said crosspiece overlying both of said contact areas.

19. A method of inhibiting the escape of vapor or gas from an electrolytic system which includes a vessel having a wall, an electrolytic bath in said vessel, and a plurality of electrodes extending into said bath, said method comprising the steps of:

holding at least one sealing member on a support so that said one sealing member is in contact with a first one of said electrodes;

holding a second sealing member on a support so that said second sealing member is in contact with a second one of said electrodes;

establishing contact between said wall and a third sealing member; and sandwiching at least a portion of said third sealing member between said supports.

20. The method of claim 19, further comprising the step of substantially aligning said portion of said third sealing member with a third electrode.

21. The method of claim 19, further comprising the step of abutting said portion of said third sealing member against a substantially complementary part of a third electrode.

22. A method of inhibiting the escape of vapor or gas from an electrolytic system which includes a vessel, and an electrolytic bath in said vessel, said method comprising the steps of:

mounting a flexible sealing member on a first electrode by sliding said flexible member and said first electrode relative to one another;

inserting said first electrode in said bath subsequent to the mounting step;

inserting a second electrode in said bath; and establishing contact between said flexible member and said second electrode.

* * * * *